US008173900B2

(12) United States Patent
Martinez et al.

(10) Patent No.: US 8,173,900 B2
(45) Date of Patent: May 8, 2012

(54) DRY, WATER-RESISTANT COAXIAL CABLE AND MANUFACTURING METHOD OF THE SAME

(75) Inventors: Leonel Yañez Martinez, Queretaro (MX); Victor Osornio Osornio, Queretaro (MX); Raul Rodriguez Camacho, Queretaro (MX)

(73) Assignee: Servicios Condumex S.A. de CV, Queretaro QRO (MX)

( * ) Notice: Subject to any disclaimer, the term of this patent is extended or adjusted under 35 U.S.C. 154(b) by 1033 days.

(21) Appl. No.: 10/613,433

(22) Filed: Jul. 3, 2003

(65) Prior Publication Data

US 2005/0016755 A1 Jan. 27, 2005

(30) Foreign Application Priority Data

Mar. 13, 2003 (MX) ..... PA/A/2003/002208

(51) Int. Cl.
*H01B 7/18* (2006.01)

(52) U.S. Cl. ..... 174/102 R; 174/108

(58) Field of Classification Search ..... 174/36, 174/102 R, 106 R, 107, 108, 110 R, 113 R, 174/120 R See application file for complete search history.

(56) References Cited

U.S. PATENT DOCUMENTS

| | | | | |
|---|---|---|---|---|
| 3,321,572 | A * | 5/1967 | Garner | 174/105 R |
| 3,795,640 | A * | 3/1974 | Mildner | 525/296 |
| 4,145,567 | A * | 3/1979 | Bahder et al. | 174/107 |
| 4,256,921 | A * | 3/1981 | Bahder | 174/107 |
| 4,703,134 | A * | 10/1987 | Uematsu | 174/106 SC |
| 5,010,209 | A * | 4/1991 | Marciano-Agostinelli et al. | 174/23 C |
| 5,043,538 | A * | 8/1991 | Hughey et al. | 174/107 |
| 5,082,719 | A * | 1/1992 | Arroyo | 428/219 |
| 5,249,248 | A * | 9/1993 | Arroyo et al. | 385/113 |
| 5,281,757 | A * | 1/1994 | Marin et al. | 174/23 R |
| 5,300,733 | A * | 4/1994 | Uematsu | 174/106 SC |
| 5,373,100 | A * | 12/1994 | Arroyo et al. | 174/23 R |
| 5,486,648 | A * | 1/1996 | Chan et al. | 174/23 R |
| 6,455,769 | B1 * | 9/2002 | Belli et al. | 174/23 C |
| 6,784,371 | B2 * | 8/2004 | Goehlich | 174/110 R |

* cited by examiner

*Primary Examiner* — William Mayo, III
(74) *Attorney, Agent, or Firm* — Carmen Pili Ekstrom

(57) ABSTRACT

Dry coaxial cable resistant to water penetration, made of a core conductor, a dielectric element based on three layers of polymers, and an external conductor and an extruded cover, characterized because it has swellable protecting elements against water penetration placed between the external conductor and the protective cover.

8 Claims, 4 Drawing Sheets

DRY, WATER-RESISTANT COAXIAL CABLE AND MANUFACTURING METHOD OF THE SAME

CROSS REFERENCE TO RELATED APPLICATIONS

The present application claims the benefit of the priority date of a prior foreign application under 35 U.S.C. §119 namely Mexican Patent Application No. 2003/002208 filed on Mar. 13, 2003. The foreign application is incorporated herein by reference.

BACKGROUND OF THE INVENTION

1. Field of the Invention

Currently, cable TV networks are designed taking into account the use of coaxial cables for signal transmission from the generation building to the subscribers. Said coaxial cables are classified in trunk, distribution and drop cables, and are usually made up of a core conductor, a dielectric insulation, and external conductor and a protective cover.

2. Previous Art

In order to connect coaxial cables to the transmission or reception equipment, it is necessary to prepare the cable to place and then seal the connectors to prevent water penetration. However, water penetration problems are common due to poor seal together with an inadequate cable installation. For example, when the cable is placed in ducts exposed to prolonged humidity such as flooding, if water penetration occurs, the cable is affected in its electrical and mechanical properties.

The current methods to prevent water penetration in this type of cables focused on the use of fillers such as oil dispersed water insoluble materials, stabilizers based on glycol, ester acetate, ethylene glycol ester or ethylene glycol ester acetate. All these materials show an adequate protection against water penetration in coaxial cables, however all of them use materials with oily adhesive and/or characteristic properties. This complicates the use of solvents to clean the cable before connecting it.

For example, in U.S. Pat. No. 5,949,018, a coaxial cable having water blocking cover is described, which includes, besides the conductor and the dielectric material around it, a first metal cover around the dielectric material and the conductor; a first metallic tape cover around and a second metallic cover around the tape; a water swellable material placed between the two covers and a second metallic tape, and a final jacket.

In patent application PCT/US01/11879, a coaxial cable is described. Said coaxial cable is protected against corrosion through the use of a composition applied on the cable, said composition being based on an oil dispersed corrosion compound and a glycolic ethers ether stabilizer, propylene glycol based on glycolic ester acetate or ethylene. Said composition is applied preferably on the external conductor of said cable.

BRIEF SUMMARY OF THE INVENTION

The applicant had developed a technique through the design of a dry cable, i.e. without filler, but incorporating within its design a water penetration prevention element, which would permit to prepare and connect the coaxial cable without using solvents and other cleaning elements.

DETAILED DESCRIPTION OF THE INVENTION

Hereinafter, the invention is described according to FIGS. 1, 2, 3 and 4 wherein.

Figure 1:
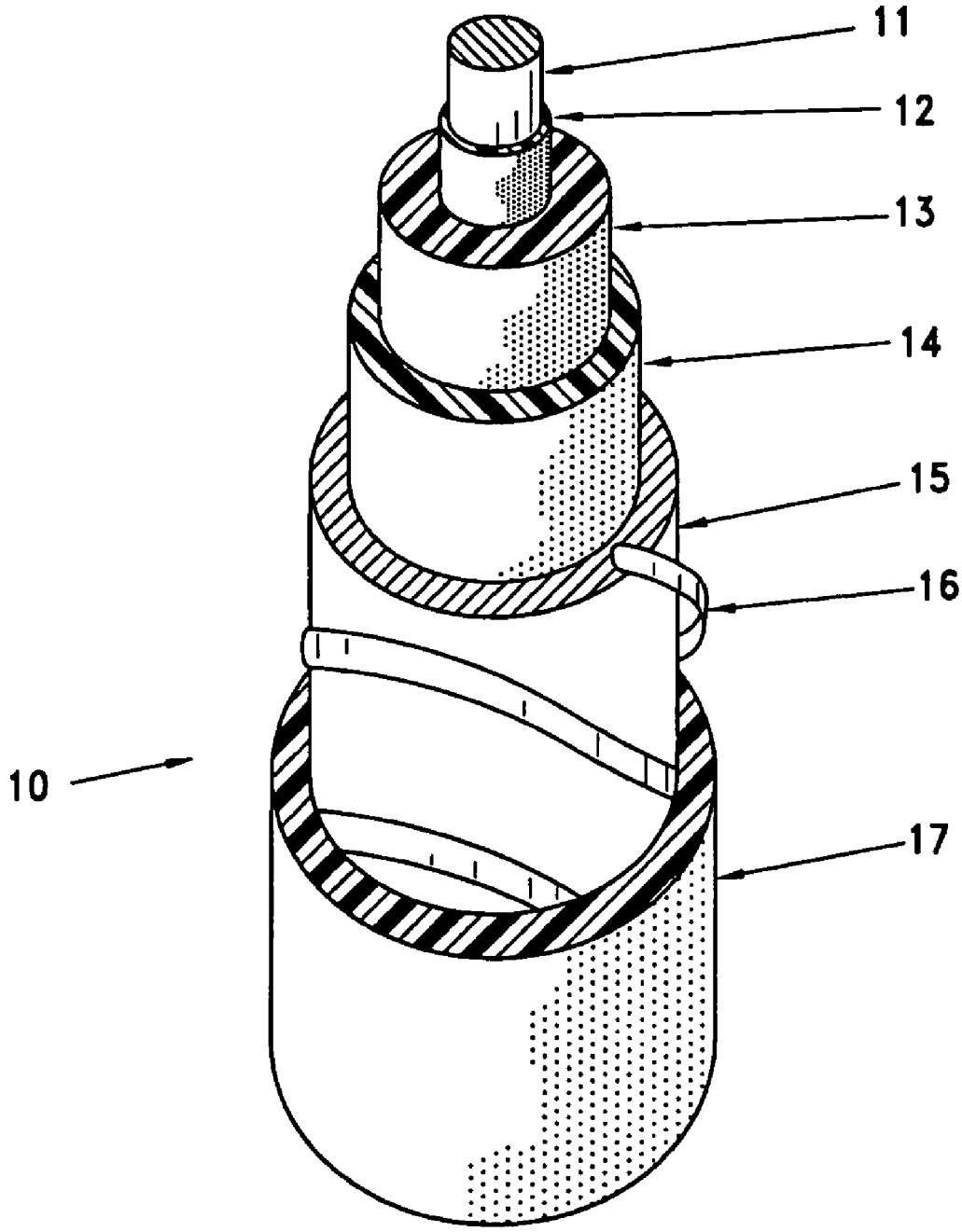
FIG. 1 is a perspective view with cross section of the dry coaxial cable.
Figure 2:
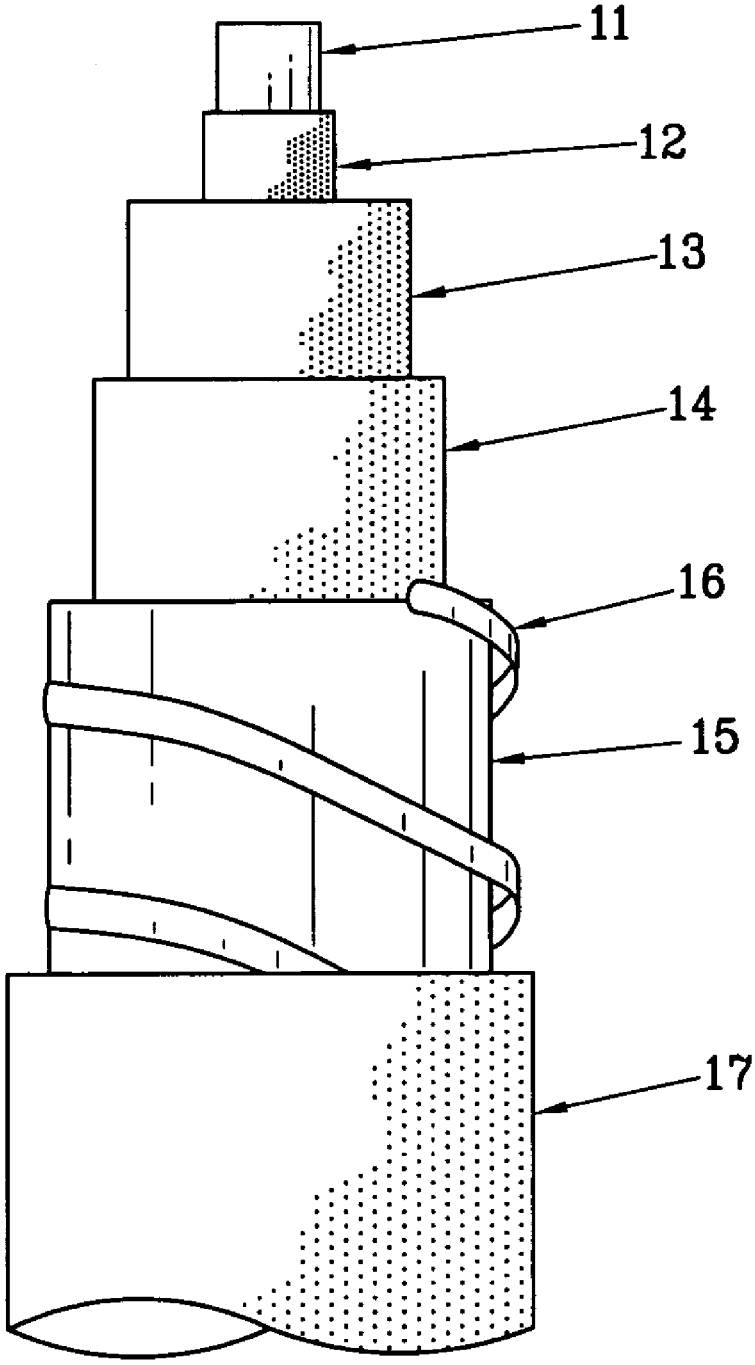
FIG. 2 is a side view with cross section of the cable of FIG. 1.

The coaxial cable 10 of FIGS. 1 and 2 is characterized because it includes a protection to prevent water penetration, specifically between the external conductor 15 and the cover 17. Said cable also includes enough elements to ensure protection against water penetration and the method through which said protective element against water penetration is placed between the external conductor and the cover is presented.

The coaxial cable 10 is normally formed by a metal core conductive element 11 which can be manufactured from different materials such as: copper alloys, aluminum alloys, or combinations of said metals with others. Said core conductor can be protected by a surrounding layer 12 of a polymer mix with an adhesive component of ethylene acrylate acid (EAA) or ethylene vinyl acid (EVA), among others, to ensure a correct watertightness between the core conductor and the dielectric. The dielectric consists of a cellular high expansion polymer, said high expansion polymer can be formed by a low density polyethylene or mixture of low, medium and high density polyethylene plus a swelling agent for controlling the swelling material that can be azodicarbonamide, p-toluene sulfonyl hydrazide, 5-phenyl tetrazol, among others. Between the dielectric and the second conductor, there can be or not a layer or film of polymer mixed with a certain proportion of adhesive such as ethylene acrylate acid (EAA) or ethylene vinyl acid (EVA), among others. The object of said second polyethylene film is to give watertightness to the swelling dielectric and to improve the surface appearance of the dielectric, and also to permit a better control of the dielectric swelling process. The second or external conductor 15 can be formed by a tape made of aluminum alloy, copper alloy or any combination of said metals with others, formed in, a tube that can be longitudinally welded, extruded or with overlapping-edges. On said second conductor a water penetration protective element is placed, said protection consisting of one or several swellable fibers or tapes made of polyester threads or other fibers as basis for the swellable element applied helically, annularly or longitudinally. Finally, on the external conductor a protective cover is placed which can be of any type of polymer such as low density, medium density and high density polyethylene or any combination of them.

FIG. 1 shows the dry coaxial cable 10 with the water penetration protection object of the instant invention. Said cable can be used as trunk or distribution cable in transmission networks for radio frequency signals, specifically for analog or digital television transmission signals as well as energy signals for activating control peripheral equipment. It can also be used for Internet signal transmission, data transmission, cellular phone, etc. Said cable is made of a solid or hollow core conductor 11 which must be manufactured with materials showing good electric conductivity, such as copper, aluminum or a combination of them. Said core can even consist of a steel part commercially known as copper plated steel or steel plated with other metal. FIG. 1 shows a solid core conductor 11, because it is the most common type. Said core conductor is protected by a low dielectric coefficient polymer film 12 which can be polypropylene or polyethylene in order to have a maximum signal propagation and a minimum attenuation. Said polymer film 12 has to be as thin as possible to maintain the transmission characteristics, but its application onto the core conductor has to be continuous and homogeneous, because otherwise electrical problems will occur such as cable signal reflection. The main object of this film 12 is to protect the core conductor against corrosion and to control the adherence between the core conductor and the dielectric. It is thus possible to add a given amount of adhesive to the film polymer, said adhesive being ethylene acrylate acid (EAA) or ethylene vinyl acid (EVA), among others. The main insulation 13 is a cellular high expansion polymer made of low dielectric coefficient polymers such as polypropylene, polyethylene or polyester, said insulation 13 having a high cellular expansion in order to lower the dielectric constant through a reduction of the polymer mass per length unit. Preferably, low density polyethylene is used or a mixture of low, medium or high density polyethylene plus a swelling agent to control the swelling, which can be azodicarbonamide, p-toluene sulfonyl hydrazide, 5-phenyl tetrazol, among others. Between the dielectric 13 and the second conductor 15, there can be or no a layer or film 14 of any mixed polymer and it can be combined with a quantity of any adhesive such as ethylene acrylate acid (EAA) or ethylene vinyl acid (EVA), among others. Said-second film 14 is formed of any low dielectric coefficient polymer such as polyethylene, having the object of giving water resistance to the swollen dielectric and improving the surface appearance of the dielectric, besides permitting a better control of the swelling process of the dielectric. This second conductor 15 covers the dielectric insulation and is constituted by a metal pipe formed around the dielectric, which can be welded longitudinally, extruded or with overlapping edges. Said second conductor 15 is made of conductive material such as aluminum, copper, or any combination of them, and can also be a braided mesh of metal wires made of copper, aluminum, or other metal alloys.

According to the invention, FIGS. 1 and 2 show the water penetration protective element 16 which is applied helically. However it can also be applied annularly or longitudinally on the second conductor. Said protective element consists of one or several swellable fibers or tapes formed by polyester threads or other fibers. As basis of the swellable element, polyacrylate fibers such as polyacrylamide, polyacrylic acid, among others, can be used.

The protective layer 17 shown in FIG. 1 must perfectly cover the second conductor 15 having a smooth and uniform appearance. Said second conductor can contain or not one or several identification fringes of the same material but different color. Said protective cover 17 gives firmness to the cable and must be formed of a thermoplastic material resistant to temperature, fire and ultraviolet light, to extreme environmental conditions, to rodents, to cuts as well as to chemicals substances. It must also present good stress resistance, besides showing low fume emissions. The thermoplastic materials used can be low, medium or high density polyethylene or any combination of these or other types of thermoplastic elements.

Figure 3:
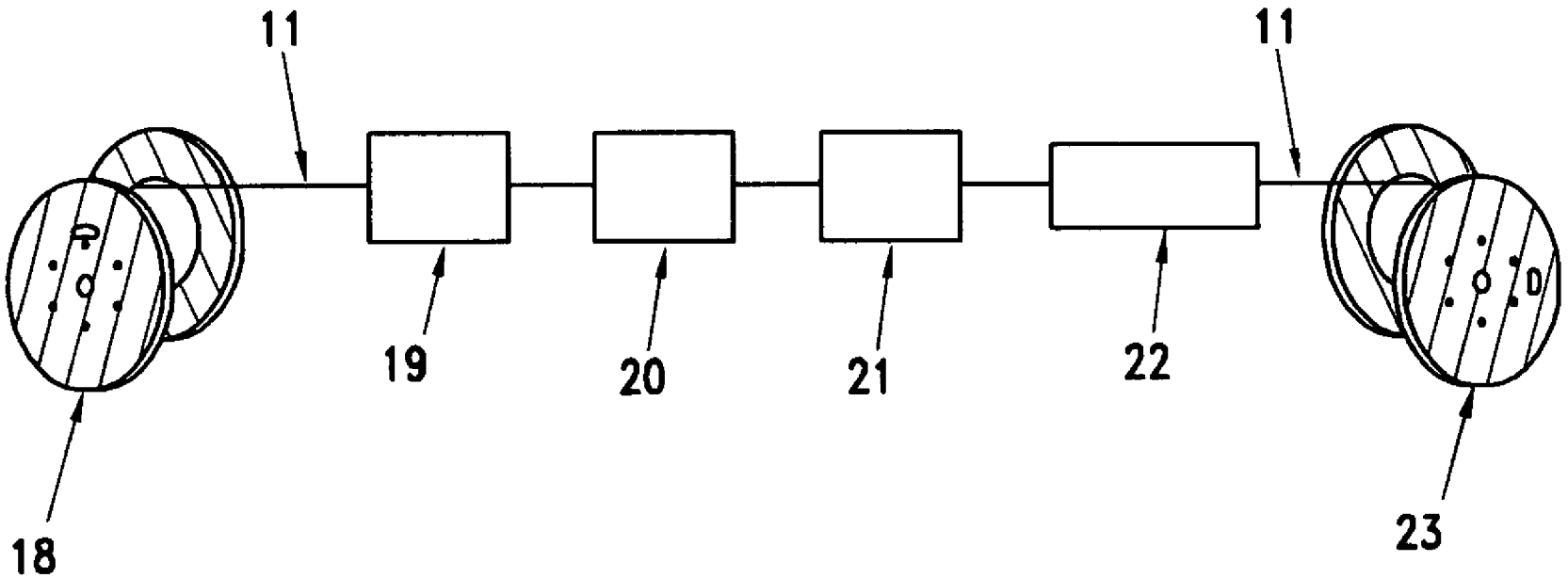
FIG. 3 is a block diagram of the manufacturing process of the dry coaxial cable in its first phase.
Figure 4:
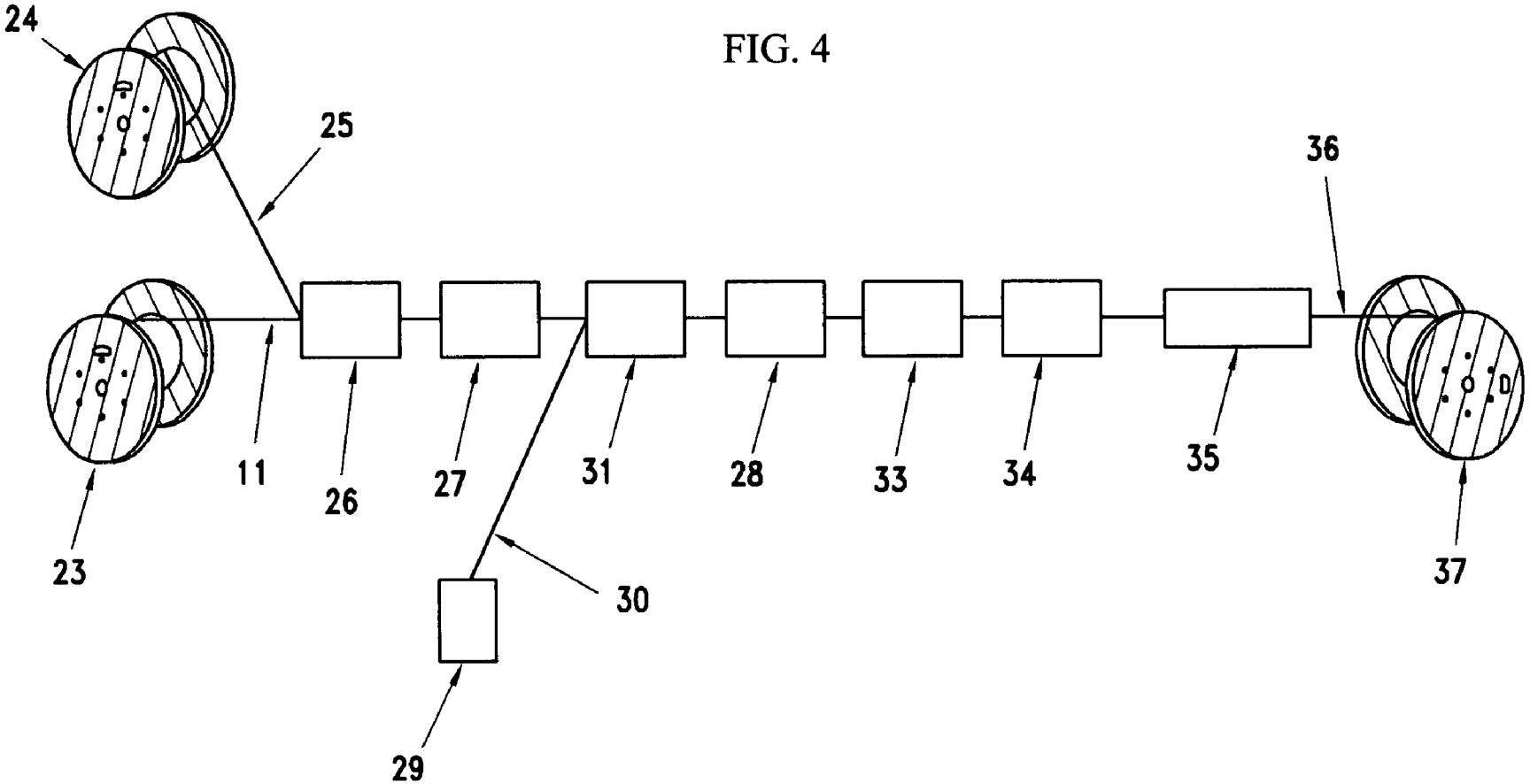
FIG. 4 is a block diagram of the manufacturing process of the dry coaxial cable in its second phase.

FIG. 3 shows a diagram of the way the core or insulation for the coaxial cable of the instant invention is manufactured. FIG. 4 shows the diagram of the application process for the second conductor, the water penetration protective element and the protective cover, in both cases the description is given from left to right. First, FIG. 3, there is the feeding reel 18 containing the core conductor 11. In order to give continuity to the process, the end of the conductor is coupled to the beginning of the conductor of the new reel through welding ensuring the absence of deformation and maintaining the requested diameter in order to conserve electrical as well as mechanical characteristics. The core conductor 11 passes then through the first polymer film applicator 19. Said film can be applied through extrusion, flooding the conductor in the insulating material and then removing the excess material or through sprinkling, as previously mentioned. This first film can be formed of polyethylene, polyester or polypropylene mixed in a given ratio with an adhesive which can be ethylene acrylate acid (EAA), among others.

The main insulating element 12 or dielectric is placed in the extrusion device 20 which can be a single extruder (simple) or two serial extruders which are known as cascade, to obtain high cellular expansion. Normally, high, low or medium density polyethylene is used, or any combination of them with a swelling control agent that can be azodicarabonamide, p-toluene sulfonyl hydrazide, phenyl tetrazol, among others, to reach high cellular expansion. Besides the above-mentioned materials, a physical expansion can be generated injecting a high pressure inert gas in the extrusion process, the gas used being Nitrogen, Argon, Carbon Dioxide, among others or any combination of these. However, there also exists the chemical swelling which is conducted directly by the swelling agent as the above-mentioned azodicarbonamide. The second polymer film is optional and is applied on the equipment 27. Said second polymer film can be equal to the first film and applied through extrusion, flooding the conductor in the insulating element and then removing the excess or through sprinkling. If it is through extrusion, said film is applied through co-extrusion, i.e., there are two extruders, one for the main insulating element 13 and the other for the second polymer film 14. Said extruders are connected to a single extrusion head appropriately designed for this purpose, as previously mentioned, said second film consisting of polyethylene, polyester or polypropylene mixed in a given ratio with an adhesive which can be ethylene acrylate acid (EAA), among others. Other option to manufacture the core is through triple co-extrusion, in which there are three extruders, one for the first film 12 another for the main insulation material 13, and the other for the second film 14, connected to an extrusion head properly designed to obtain the core with the 3 above-mentioned interfaces.

Once the core or central insulation 11 is obtained, it must be cooled to prevent deformation when winding it, which is made in the cooling trough 22 and water at controlled temperature, air, vapor, or any combination of them can be used. Finally, the core is stored on a reel 23 to be sent to the following process.

The diagram in FIG. 4 starts with the feeding reel 23 containing the core 11 onto which a pipe denominated second conductor 15 is placed. Said pipe can be made of aluminum, copper or any combination of them. According to the initial description of the product, there are three options for the application of the second conductor: welded tape, overlapped tape, or through extrusion. In the case of welded or overlapped tape conductor, FIG. 4 shows the tape winding equipment 24 which receives the tape 25 in rolls and unwinds it to be introduced to the process. Said tape 25 is formed around the core 11 through the appropriate equipment 26, for example through forming rollers or dice. With regard to a welded second conductor 15, this welding process is conducted on the equipment 29 through a high frequency or Tig process. After welding, the pipe is submitted to a trimming step in which burrs or welding process imperfections are eliminated giving a round and uniform pipe. Then, the core-external conductor complex passes through a diameter adjustment box which can contain 1 to 4 dice which reduce the pipe diameter to adjust and even compress the core 11 insuring a good contact and coverage of the core 11. During this process, a lubricant has to be used to prevent damage to the pipe and the dice. If the second conductor is applied through overlapping of the edges, it will go directly from the forming equipment 26 to the diameter adjustment box 28 where it will be adjusted to the core 11, being ready for the following process step. In this case, no lubricant is used. If the second conductor 15 is applied through extrusion, the material used will be preferably an aluminum alloy and the process will include a device 29 for unwinding the wire rod 30 to be introduced to the process. Said wire rod 30 together with the core 11 penetrate into an appropriate extrusion device 31 in which the wire rod is extruded around the core, forming a pipe. Then, the core-external conductor complex passes through the diameter adjustment box 28 which can contain 1 to 4 dice which reduce the pipe diameter to adjust and even compress the core 11 insuring a good contact and coverage of the core 11. During this process, a lubricant has to be used to prevent damage to the pipe and the dice.

The cable 32 indicated in FIG. 4 passes through the adequate device 33 for its application onto the second conductor 15 of the water penetration protective element 16 object of the instant invention. Said protective element consists of one or various swellable fibers or tapes made of polyester threads or other fibers as basis of the swellable element. Said fibers or tape are preferably applied helically, however they can also be applied annularly or longitudinally. Once the water penetration protective element 16 is applied, the cable passes through an extruder 34 where the protective cover 17 is applied. Said cover is formed of a resistant thermoplastic element which can be low, medium or high density polyethylene or any combination of them or other types of thermoplastic elements. If necessary one or several identification fringes made of the same material but of different colors, can be made through co-extrusion using the same extrusion head.

Once the cable 36 is obtained, it is protected by the cover and has to be cooled to prevent deformations when winding it, and this is conducted in a cooling trough 35 using water at controlled temperature. Finally the cable 36 is stored on a reel 37 to be stored, cut or shipped.

Material Characteristics and Cable Construction

Internal Conductor (Core)

The core conductor is made of copper plated aluminum wire, with a 3.15±0.03 mm diameter; it also has a uniform round cross section, seamless and imperfection free, and meets the requirements of ASTM B 566 standard, Class 10A.

Dielectric

The dielectric consists of three layers. The first layer, the conductor, is a uniformly thick film made of low density polyethylene mixed with adhesive. Said layer links the conductor to the dielectric and acts as a moisture blocking element and minimizes the presence of air bubbles that contribute to the instability of the characteristic impedance and the structural return losses (SRL). The second layer of the dielectric is a polyethylene mix physically expanded through gas injection. The materials used have to be virgin. Recycled or reprocessed materials shall not be used. The dielectric is to be applied concentrically on the conductor, adhering onto it, and shall have a 13.0±0.10 mm diameter. The third layer has the same properties as the first layer and ensures the surface uniformity of the intermediate layer and enhances the adherence of the aluminum pipe onto the dielectric. The polyethylene mix used in the dielectric shall fulfill the requirements of standard ASTM D 1248 Type I, III and IV, Class A, category 3.

External Conductor

The external conductor is a cylindrical pipe made of aluminum alloy 1350, and shall meet the requirements of ASTM B 233. The thickness of the pipe shall be 0.34 mm and its diameter shall be 13.70 mm±0.10 mm.

Water Blocking Threads

The external conductor is helically surrounded with a pair of water blocking threads. Said threads have an absorption speed ≧15 ml/g per minute and their absorption capacities is about 30 ml/g.

External Cover

The external cover is made of medium density black polyethylene, adding the precise ratios of antioxidant and carbon black to ensure the best conditions against weathering, including protection against UV rays.

The surface of the cover shall be free of holes, cracks and any other defect.

The cover diameter shall be 15.5 mm±0.10 mm, with a 0.67 mm±0.02 mm thickness.

The polyethylene used for the cover shall meet the following characteristics:

| Characteristic | Value | Test method |
|---|---|---|
| Density (g/cm$^3$) | 0.900-0.955 | ASTM D 1505 |
| Minimum elongation (%) | 400 | ASTM D 638 |
| Minimum elongation Retention (%) | 75 | ASTM D 573 After 48 hours at 100° C. |
| Carbon Black Contents (%) | 2.35-2.85 | ASTM D 1603 |

Physical Tests:

Cable Bending Test

The complete cable must fulfill all the requirements established in standard EN 50117, Clause 10.2 for the bending test.

Cable Tensile Stress Test

The cable shall withstand a maximum tensile stress of 980 N, without presenting changes in the electrical characteristics specified in this document. Besides, the cable shall not present cracks or ruptures in the insulation, in the metal elements or in the cover, after having been submitted to the tests described in standard EN 50117, Clause 10.3.

Compressive Strength Test

The cable must pass the compressive strength test conducted according to standard EN 50117, Clause 10.4. After a maximum recovery time of 5 minutes, the maximum irregularity will be below 1%.

Insulation Longitudinal Contraction Test

Samples of insulated conductor shall be submitted to contraction test according to the procedures specified in ASTM D 4565. The total contraction of the insulation shall not be over 6.4 mm.

Cover Longitudinal Contraction Test

The cable cover shall be tested to measure its longitudinal contraction, following the procedure established in standard SCTE IPS-TP-003. The contraction shall not be above 9.52 mm in a 152 mm long sample.

Test of Adherence Between the Core Conductor and the Insulation

The core conductor shall adhere onto the dielectric material insulating the cable. Said adherence shall be strong enough to prevent sliding between the two elements, but must also allow the separation of said two elements during cable preparation for connection. The test shall be conducted according to standard EN 50117, Clause 10.1.

Weathering Test

The finished cable shall be submitted to the weathering test according to the procedures established in standard EN 50117, Clause 10.6. This test is conducted in order to determine the capacity of the cable to maintain its electrical characteristics and the cover integrity in case of weather changes.

Electrical Characteristics of the Finished Product

The cable shall present the following electrical characteristics when they are evaluated according to standard EN 50117-1:

Core conductor DC resistance @ 20° C.: 3.34 Ω/km

External conductor DC resistance @ 20° C.: 1.94 Ω/km

Minimum electrical resistance of the insulation: $10^4$ MΩ/km

Capacitance @ 1KHz: 50.00±3.0 pF/km

Characteristic impedance @ 1≦f≦1000; f(MHz): 75.00±2.0 Ω

Propagation speed: 88%

| Frequency (MHz) | |
|---|---|
| Attenuation @ 20° C. | |
| | DB/100 m |
| 5 | 0.46 |
| 30 | 1.12 |
| 55 | 1.53 |
| 108 | 2.16 |
| 150 | 2.57 |
| 211 | 3.12 |
| 250 | 3.38 |
| 300 | 3.71 |
| 350 | 4.02 |
| 400 | 4.31 |
| 450 | 4.57 |
| 500 | 4.88 |
| 550 | 5.12 |
| 600 | 5.31 |
| 750 | 6.07 |
| 800 | 6.28 |
| 862 | 6.56 |
| 900 | 6.85 |
| 950 | 6.93 |
| 1000 | 7.12 |
| Return losses @ 20° C. | |
| | dB |
| 5-1000 | ≧30 |

Mechanical Characteristics of the Product

The cable shall present the following mechanical characteristics tested according to standard EN50117-1:

| | |
|---|---|
| Maximum stress without change in electrical properties: | 980 N |
| Minimum bending radio: | 102 mm |
| Adherence onto the dielectric: | ≧1.3 Mpa |

The cable shall be designed to operate at temperatures between −40 to 80° C. and shall present a nominal net weight of 140 Kg/Km.

It will be recognized by persons skilled in the art that numerous variations and modifications may be made to the invention without departing from the spirit and scope of the invention.

The invention claimed is:

1. A dry, water resistant coaxial cable consisting of: a metal core conductor element, a dielectric element around the core conductor based on three layers, the first layer being applied onto the conductor as a uniformly thick film based on low density polyethylene mixed with a vinyl or acrylic adhesive, the second layer being based on an expanded polyethylene mix consisting of low density polyethylene or mixture of low, medium and high density polyethylenes and a swelling agent selected from azodicarbonamide, p-toluene sulphonylhydrazide, or 5-phenyltetrazol, and optionally a reinforcement layer of the same characteristics as the first layer; wherein it has a second external conductor element formed by a tape made of an aluminum or copper alloy or combined with other elements and surrounding said conductor consisting of a water penetration protective element keeping it dry and based on one or several swellable fibers or tapes formed by polyester threads or other swellable fibers; and the protective cover based on low, medium, high density polyethylene or a combination thereof.

2. The dry coaxial cable according to claim 1 wherein the core conductor is copper plated aluminum wire, with a uniform circular cross section of 3.15±0.03 mm diameter.

3. The dry coaxial cable according to claim 1 wherein the adhesive component is chosen between ethylene acrylate acid or ethylene vinyl acid permitting better adherence and water resistance between the core conductor and the dielectric element.

4. The dry coaxial cable according to claim 1 wherein the second polyethylene film applied onto the core conductor shows better watertightness to the swellable dielectric improves its superficial appearance and offers a 13.0±0.10 mm diameter.

5. The dry coaxial cable according to claim 1 wherein the external conductor is formed by a tape made of aluminum or copper alloy or mixture thereof is formed in a cylindrical pipe and can be longitudinally welded, extruded or the edges can be overlapped and it has a thickness of 0.34 mm and the diameter on the pipe is 13.7±0.10 mm diameter.

6. The dry coaxial cable according to claim 1 wherein the water penetration protective element consists of swellable tapes placed helically, annularly or longitudinally.

7. The dry coaxial cable according to claim 6 wherein the moisture protection elements have an adsorption speed of ≧15 ml/g per minute and their absorption capacity is over 30 ml/g.

8. The dry coaxial cable according to claim 1 wherein the external cover is made of medium density polyethylene and has a diameter on cover of 15.5 mm±0.10 mm with a 0.67 mm±0.02 mm thickness.

* * * * *